United States Patent [19]

Mardigian

[11] Patent Number: 4,458,846

[45] Date of Patent: Jul. 10, 1984

[54] APPARATUS AND PROCESS FOR RECLAIMING WOOD FROM DEBRIS

[76] Inventor: Henry C. Mardigian, 8095 Colony Dr., Grosse Isle, Mich. 48138

[21] Appl. No.: 320,789

[22] Filed: Nov. 12, 1981

[51] Int. Cl.[3] ..... B02C 23/12; B02C 23/18; B02C 23/40

[52] U.S. Cl. ..... 241/20; 241/24; 241/28; 241/41; 241/79.1; 241/80

[58] Field of Search ..... 241/20, 24, 28, 41, 241/68, 79, 79.1, 80, 81; 209/162, 173; 414/272; 83/479; 222/144.5

[56] References Cited

U.S. PATENT DOCUMENTS 3,095,097 6/1963 Mellow ..... 414/272 X
3,817,459 6/1974 Keller et al. ..... 241/20
3,910,429 10/1975 Zumsteg et al. ..... 414/272
4,169,787 10/1979 Gunnerson ..... 209/173

*Primary Examiner*—Howard N. Goldberg
*Assistant Examiner*—Timothy V. Eley
*Attorney, Agent, or Firm*—Krass and Young

[57] ABSTRACT

Wood is removed from debris in processes alternately conducted in a pair of side-by-side water filled tanks. Each tank includes an inclined bottom defining a deep end where sinking materials settle and a shallow end. Water jets along two adjacent sides of each tank creating a flow of surface water and floating wood toward one corner of the shallow end where the wood accumulates and is removed. Runways along two sides of each tank support debris handling equipment. A conveyor under one runway transfers the sinking materials away from the tanks. The wood is comminuted and sized for use as fuel.

10 Claims, 5 Drawing Figures

APPARATUS AND PROCESS FOR RECLAIMING WOOD FROM DEBRIS

DESCRIPTION

1. Technical Field

The present invention broadly relates to debris separation, and deals more particularly with a process and apparatus for reclaiming wood from debris.

2. Background Art

The need for energy conservation and the rising costs of fossil fuel have recently made it economically feasible to reclaim used wood from debris, such as that produced by demolition of buildings, for reuse as fuel. Used wood is particularly attractive as a source of fuel for furnaces or the like because of its inherently low moisture content and low sulphur emission when burned.

Processes for reclaiming used wood from debris are known in the art as evidenced by U.S. Pat. No. 3,817,459 to Keller, issued June 18, 1974. This prior art process involves introducing the debris into a water filled tank in order to effect a separation of floating material (wood) from the sinking material. The floating wood is removed to a wood mill for shredding into smaller pieces which may then be sold for use as fuel. The Keller process is quite satisfactory for debris which contain a minimum amount of heavier-than-water material in relatively small pieces. However, this process has been found to be rather unsuitable for some types of demolition debris; for example, items such as stoves, metal beams, and plumbing fixtures are difficult to remove from the water tank and rapidly accumulate to interfere with the debris separation process. Consequently, it has been necessary in the past to prescreen certain kinds of debris in order to remove the larger, more awkward items therefrom before the debris could be processed. At the present, however, it is not cost effective to prescreen the debris in this manner, and it is therefore impractical to reclaim wood from such debris.

In view of the above, it is apparent that there is a clear need in the art for a process and apparatus for efficiently reclaiming used wood from debris which includes heavy or bulky objects. Accordingly, it is a primary object of the present invention to provide a device implemented process for separating used wood from heavier-than-water material.

Another object of the invention is to provide a process and apparatus as described above which eliminates the problem of rapid build up of sinking items in a water filled tank used in the separation process.

A still further object of the present invention is to provide apparatus as described above which includes means for generating a floatsom of the wood in one corner of the tank in order to facilitate removal of the wood.

Another object of the invention is to provide apparatus similar to that disucssed above which effects efficient removal of sinking materials from the tank without the need for a submerged conveyor.

DISCLOSURE OF THE INVENTION

Debris containing wood is introduced into the deep end of either of two adjacent, water filled tanks each of which has an inclined bottom defining a deep end and a shallow end. Water jets along two adjacent sides of each tank create a flow of the surface water and floatsom toward one corner of the shallow end of the tank. The floatsom and sinking debris is removed by apparatus which moves along runways along the sides of the tanks. The sinking debris is transferred by a conveyor beneath one of the runways to a reclamation area while the floatsom is delivered to a comminution and sizing operation for processing into fuel.

BRIEF DESCRIPTION OF THE DRAWINGS

In the drawings, which form an integral part of the specification and are to be read in conjunction therewith, and in which like references numerals are employed to designate identical components in the various views.

DETAILED DESCRIPTION OF THE INVENTION

Figure 1:
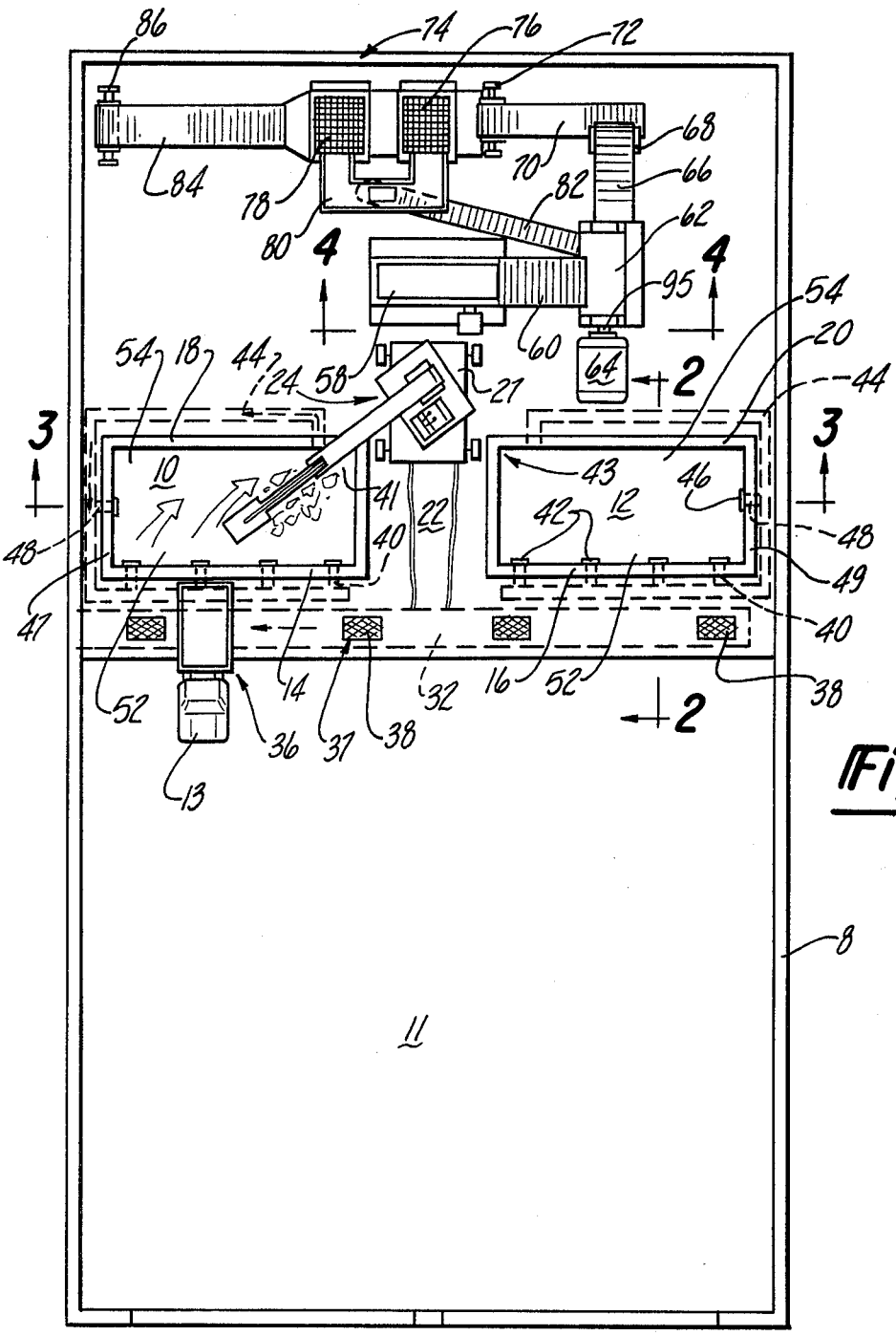
FIG. 1 is a plan view of a facility for reclaiming used wood from debris, which includes the apparatus forming the preferred embodiment of the present invention.
Figure 2:
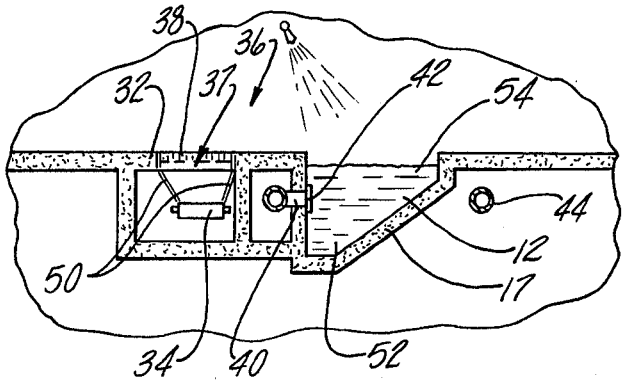
FIG. 2 is a sectional view taken along the line 2—2 of FIG. 1.
Figure 3:
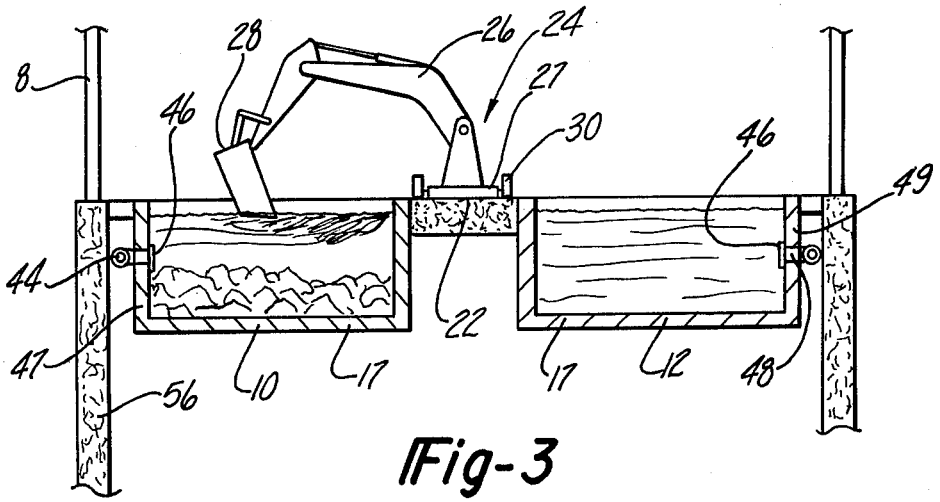
FIG. 3 is a sectional view taken along the line 3—3 of FIG. 1.
Figure 4:
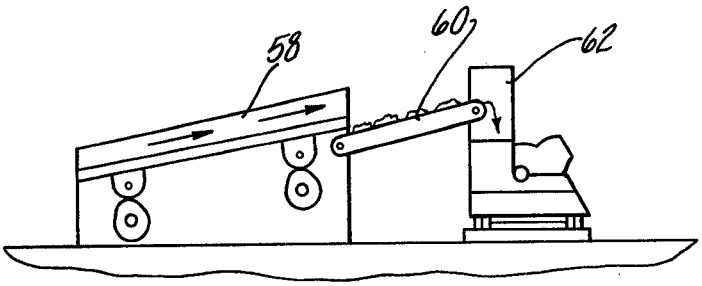
FIG. 4 is an elevational view taken along the line 4—4 of FIG. 1.
Figure 5:
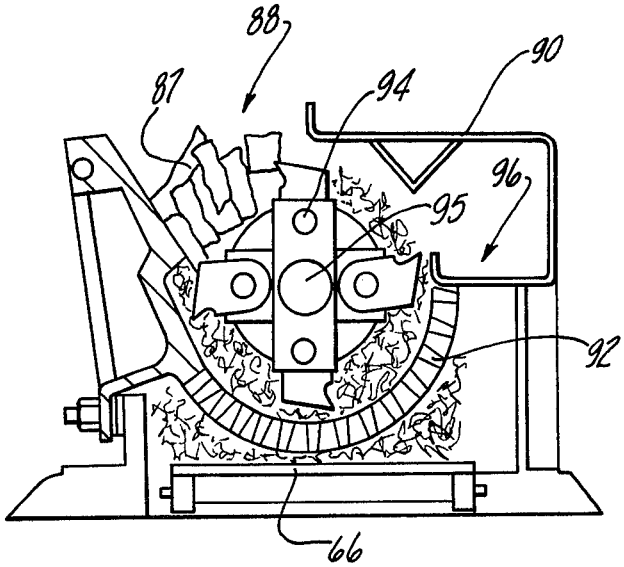
FIG. 5 is a cross-sectional view of the hammermill forming a portion of the apparatus shown in FIG. 1.

Referring to the drawings, the present invention is broadly concerned with a facility and process for reclaiming wood from debris such as that produced by the demolition of a building or the like. As seen in FIG. 1, the facility may be rectangular in overall shape so as to be contained, if desired, within a covered building 8 supported by a foundation 56. The facility includes an entry area 11 through which vehicles such as trucks 13 carrying debris may approach any of a plurality of receiving stations 36 along one side of each of a pair of water filled tanks 10 and 12.

Tanks 10 and 12 are of generally rectangular shape and are separated by a support runway 22 extending therebetween which connects with a longitudinal runway 32 along the forward walls 14, 16 of tanks 10 and 12. Tanks 10 and 12, as well as runways 22 and 32, may be constructed of reinforced concrete if desired. As shown particularly in the drawings, tanks 10 and 12 are sized such that each includes four receiving stations 36 to allow introduction of debris by dumping into the tank 10 and 12 from four trucks 13 disposed side-by-side.

Each of the tanks 10 and 12 includes an inclined bottom wall 17 which defines a deep end 52 of the tank adjacent corresponding front walls 14 and 16, and a shallow end 54 along the rearwalls 18 and 20. By way of example, the deep end 52 may be on the order of 10 to 12 feet deep and the shallow end may be approximately 2 to 3 feet deep. However, it is recognized that these dimensions will vary depending upon the type of debris which is being processed.

Each tank 10, 12 is provided with a water jet pump 40 at each receiving station 36. Pumps 40 may be of the centrifugal type and include an outlet jet 42 typically 18 inches below the surface of the water. An additional pump 48 of the type described above having an outlet 46 is defined in an adjacent end 47, 49 of the associated tank 10, 12. Water is supplied to pumps 40 and 48 by a return line 44 which circulates water between the rearwalls 18, 20 and the inputs of each of the pumps 40 and 48. Pumps 40 and 48 produce flow of surface water in perpendicular directions such that the net flow of surface water is toward collection areas 41 and 43 defined in adjacent corners of the tanks 10 and 12, at the shallow end 54 thereof.

Means generally at 24 for removing material from the tanks 10 and 12 comprises a vehicle 27 supported as by wheels 30 for travel along either of runways 22 and 32. As particularly shown in the drawings, removing means 24 may include a hydraulically operated, elevationally shiftable, extensible arm 26 rotatably mounted on vehicle 27, and means, such as a bucket 28 on arm 26, for seizing and lifting materials. Removing means 24 is employed to remove wood floating in the collection areas 41, 43 and transfer the same to a later discussed vibratory feeder 58. Removing means 24 is also employed to remove the materials that sink in the deep end 52 of tanks 10 and 12 to a conveyor 34 disposed immediately beneath runway 32 and substantially co-extensive therewith. Access to the conveyor 34 may be gained at each of a plurality of locations through access openings 37 in runway 32 covered by removable closures 38. Debris introduced through access openings 37 is held on the conveyor 34 by inclined sidewalls 50 which extend essentially the entire length of the conveyor 34. Conveyor 34 may be of a powered type and delivers materials to a reclamation site which may be outside the building 8.

As previously indicated, wood removed from collection areas 41 and 43 of tanks 10 and 12 respectively, is introduced into the vibratory feeder 58 which is a conventional device operative to deliver the reclaimed wood at a substantially constant feed rate to a conveyor 60 which in turn charges a hammermill 62. Hammermill 62 is a shredding device well known in the art such as that manufactured by Williams of St. Louis, Mo. and designated by the manufacturer's trade name "NONIFE". Hammermill 62 is driven by an electric motor 64 connected to an axle 95 which rotates a plurality of hammer members 94 contained within a housing 90. Large pieces of wood 87 delivered by the conveyor 60 are received within an input opening 88 in housing 90. Comminuted wood pieces and chips drop through a perforated cage 92 onto a conveyor 66. A trap 96 is provided to capture tramp metal carried along with the wood.

Following comminution, the wood chips are delivered via conveyors 66 and 70 to a sizing apparatus 74 which is well known in the art. Apparatus 74 includes a pair of vibrating chip screens 76 and 78 through which chips of a predetermined size may pass. Wood chips too large to pass through screens 76 and 78 are delivered by a return chute 80 to conveyor 82, thence back to the hammermill 62 for further size reduction. Chips dropping through screens 76 and 78 are moved by conveyor 84 to a staging location where the chips are packaged and shipped for use as fuel. In order to assure that the chips are substantially free of tramp metal, such as nails, etc., conveyors 66, 79 and 84 may include corresponding magnetic pulleys 68, 72 and 86 which attract and separate the metal, which then falls away from the corresponding conveyor under the influence of gravity.

In operation, the used wood reclamation process is preferably performed alternately in tanks 10 and 12. Trucks 13 entering the building 8 through entry area 11 back up onto one of the receiving stations 36 on runway 32. Assuming for the moment that the process is started in tank 10, debris is dumped over the front wall 14 into the deep end 52. The heavier-than-water materials sink immediately to the bottom of the tank while the wood is carried as a floatsom by the flow of surface water toward the collection area 41. The wood collecting in area 41 is periodically transferred to the vibratory feeder by removing means 24, as required. Debris may be continuously or periodically introduced into tank 10 until the sinking materials accumulate and displace the water in the deep end 52 of tank 10. At this point, the debris dumping operation is transferred to the deep end 52 of tank 12 and transferring means 24 commences transferring submerged material in the deep end 52 of tank 10 through openings 37 onto conveyor 47. After substantially all the submerged material in tank 10 has been removed therefrom, the covers 38 are replaced and tank 10 is thereafter ready for receiving additional debris. When the deep end 52 of tank 12 becomes substantially filled with sinking material, the debris dumping process is transferred back to tank 10 while tank 12 is cleared of submerged material in a manner previously described.

From the foregoing, it is apparent that the apparatus and process for reclaiming used wood from debris described above not only provides for the reliable accomplishment of the objects of the invention but does so in a particularly efficient and reliable manner. It is recognized, of course, that those skilled in the art may make various modifications or additions to the preferred embodiment choosen to illustrate the invention without departing from the spirit and scope of the present contribution to the art. Accordingly, it is to be understood that the protection sought and to be afforded hereby should be deemed to extend to the subject matter claimed and all equivalents thereof fairly with the scope of the invention.

I claim:

1. Apparatus for reclaiming used wood from debris, comprising:

first and second tanks each adapted to be filled with a quantity of water and within which said wood may be separated from the reminder of said debris, said first and second tanks being disposed in side-by-side relationship to each other; and means disposed between and selectably introducable into either of said first and second tanks for removing said wood floating in the water within either of said tanks and for removing said remainder of said debris which sinks below the surface of said water.

2. The apparatus of claim 1, wherein said tanks are spaced apart and there is further provided a support between said tanks, said removing means being shiftably disposed on said support for movement therealong.

3. The apparatus of claim 2, wherein said support includes an elongate runway and said removing means includes a wheeled vehicle having an extendable, elevationally shiftable means for seizing and lifting said wood.

4. The apparatus of claim 1, including a first runway interposed between said tanks and extending substantially coextensive with one dimension of each of said tanks and a second runway spanning substantially both of said tanks and extending essentially transverse to said first runway, said removing means being supported by either of said runways for movement therealong.

5. The apparatus of claim 4, including means beneath said second runway for conveying heavier than water portions of said debris away from said tanks and means for allowing access to said conveying means through said second runway.

6. The apparatus of claim 1, wherein each of said tanks is generally rectangular in shape and there is further provided means for urging said floating wood toward one pair of adjacent corners of said tanks.

7. The apparatus of claim 6, wherein said urging means includes first means along one edge of each of said tanks for creating a first flow of surface water toward an edge opposing said one edge of the corresponding tank and second means along another edge of each of said tanks adjacent said one edge for creating a second flow of surface water in a direction generally transverse to said first flow, said first and second flows cooperating to carry said floating wood into said adjacent corners of said tanks.

8. The apparatus of claim 7, wherein each of said tanks includes an inclined bottom defining a shallow end and a deep end of the associated tank and there is further provided means spanning said tanks adjacent the respective deep ends thereof for conveying heavier than water portions of said debris away from said tanks, said deep end of said tanks being disposed along said one edge of the corresponding tank.

9. The apparatus of claim 1, including:

means for comminuting said wood;

means for delivering said wood to said comminuting means at a generally even rate; and means for sizing the comminuted wood.

10. The apparatus of claim 9, wherein said sizing means includes:

means for separating said comminuted wood into first, second and third sizes, said second size being greater than said first size, said third size being greater than said second size, and means for returning comminuted wood of said third size to said comminuting means for further comminution.

* * * * *